United States Patent [19]

Ichiba

[11] Patent Number: 4,673,138

[45] Date of Patent: Jun. 16, 1987

[54] APPARATUS FOR PREVENTING SCATTER OF FLY IN WINDER

[75] Inventor: Yoshiyuki Ichiba, Kyoto, Japan

[73] Assignee: Murata Kikai Kabushiki Kaisha, Kyoto, Japan

[21] Appl. No.: 834,191

[22] Filed: Feb. 26, 1986

[30] Foreign Application Priority Data

Mar. 1, 1985 [JP] Japan ..... 60-41585

[51] Int. Cl.[4] ..... B65H 54/20; B65H 59/00; B65H 49/00

[52] U.S. Cl. ..... 242/35.5 R; 57/304; 57/305; 57/354; 242/35.6 R; 242/149

[58] Field of Search ..... 242/35.5 R, 35.5 A, 242/35.6 R, 18 R, 128, 147 R, 149, 150 R; 57/304, 305, 352, 354, 355, 356, 357

[56] References Cited

U.S. PATENT DOCUMENTS

| | | | |
|---|---|---|---|
| 2,745,239 | 5/1956 | Kingsbury | 57/354 |
| 3,304,027 | 2/1967 | Stanier | 242/150 R |
| 3,807,159 | 4/1974 | Hamel | 242/128 X |
| 3,857,228 | 12/1974 | Nakahara et al. | 57/304 |
| 3,977,169 | 8/1976 | Suzuki et al. | 57/354 X |
| 4,107,910 | 8/1978 | Furstenberg et al. | 57/304 X |
| 4,107,911 | 8/1978 | Yamana et al. | 57/304 |

FOREIGN PATENT DOCUMENTS

| | | | |
|---|---|---|---|
| 902096 | 7/1962 | United Kingdom | 242/35.5 R |

*Primary Examiner*—Stanley N. Gilreath
*Attorney, Agent, or Firm*—Spensley Horn Jubas & Lubitz

[57] ABSTRACT

An apparatus for preventing scatter of fly in a winder having a plurality of winding units where a yarn is unwound from a yarn feeding bobbin and is taken-up on a take-up package. A first cover member for covering the yarn feeding bobbin unwound at a winding unit and a second cover member for covering a tenser portion are provided with each winding unit.

17 Claims, 14 Drawing Figures

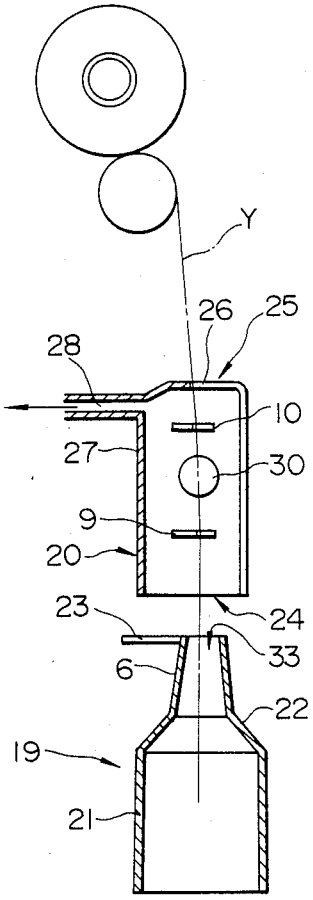
FIG. 2
FIG. 4
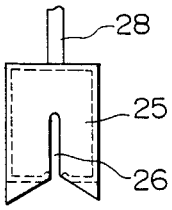
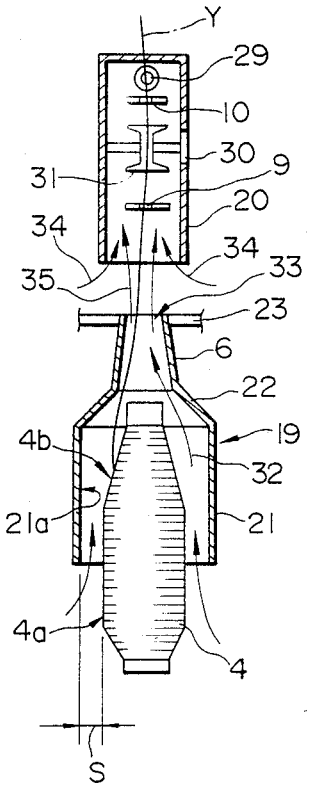
FIG. 3

APPARATUS FOR PREVENTING SCATTER OF FLY IN WINDER

FIELD OF THE INVENTION AND RELATED ART STATEMENT

This invention relates to an apparatus for preventing scatter of fly waste in a winder.

In the conventional type of a winder, it has been proposed for a countermeasure for removing fly that a truck having a cleaning pipe composed of either a suction pipe or a blowing pipe suspended therefrom is reciprocated or run along a ceiling rail above the winder or an air curtain and the like disclosed in Japanese Patent Publication No. 51-6779 and other various types of devices have been proposed.

In either one of the above-described devices, it is hard to make a complete removal of the fly generated from the winder unit, in case of applying a moving cleaning pipe, the winding unit is merely intermittently cleaned and the cleaning is quite insufficient. In turn, in case of the type in which a concentric injection of the belt-like air flow is made from above the winder directly toward the front surface of the winding unit, an air pressure may be dispersed and decreased at the lower yarn feeding bobbin, that is, near the place where the fly is mostly generated, much volume of fly generated from the yarn feeding bobbin is dispersed into the atmosphere, resulting in causing contamination of air in the factory.

OBJECT AND SUMMARY OF THE INVENTION

It is an object of the present invention to provide an apparatus for enabling an effective discharge of fly generated from the winder.

The present invention is made such that a cover for protecting a place where the fly may easily be generated in particular, for example, a tension applying part and a yarn feeding bobbin, and a suction pipe is connected to a part of the cover to cause the generated fly to be enclosed in the cover and then the fly is sucked and discharged from it.

BRIEF DESCRIPTION OF THE DRAWINGS

FIG. 2 is a side elevational view for showing an arrangement of a second cover.

FIG. 3 is a front elevational view of FIG. 2.

FIG. 4 is a top plan view for showing a second cover.

DETAILED DESCRIPTION OF PREFERRED EMBODIMENTS

Figure 1:
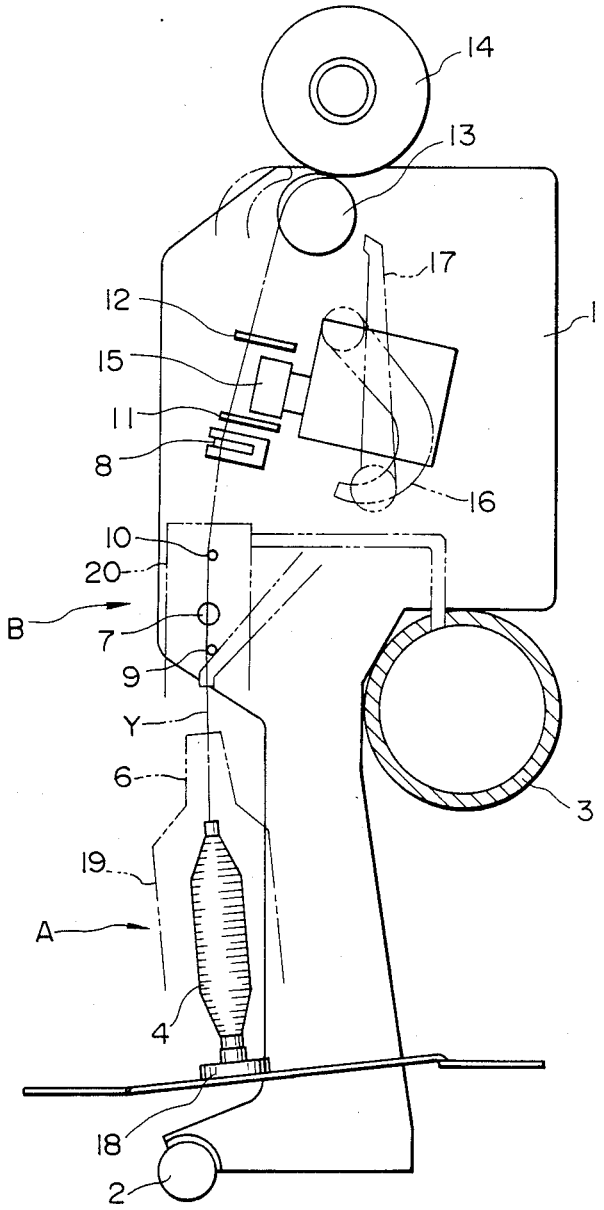
FIG. 1 is a schematic side elevational view for showing a preferred embodiment of the present invention.

In FIG. 1 is shown one example of a winding unit. The winding unit 1 is fixed at its position by a supporting pipe 2 and a suction pipe 3, a yarn Y drawn from a yarn feeding bobbin 4 positioned and supplied to a desired position of the unit is passed through a balloon breaker 6, a tension unit 7, a slub catcher 8 and the like via some guides 9, 10, 11 and 12 and the like and then taken up on a take-up package 14 rotated by a traverse drum 13. A reference numeral 15 denotes a yarn joining device, a reference numeral 16 designates a suction mouth for guiding the yarn at the package to the yarn joining device 15, a reference numeral 17 indicates a relay pipe for guiding the yarn at the yarn feeding bobbin to the yarn joining device 15, each of the winding units has each of the above-described members, and several winding units 1 are arranged side-by-side so as to constitute one automatic winder.

Although there are applied various methods for feeding the yarn feeding bobbin 4 to the desired position in the winding unit 1, in the preferred embodiments of the present invention, there is illustrated such a winder, as the yarn feeding bobbin may be transported or fed to a winding unit, unwound at the winding unit and discharged from the winding unit while the yarn feeding bobbin 4 being independently inserted and erected on a bobbin tray 18, respectively. Of course, it is possible to apply various types of winders such as one having a magazine for storing a plurality of bobbins, or one in which each of the winding units is not a fixed type as described above and is circulated or moved along an elliptical orbit and the like.

In FIG. 1, in case that a spinning bobbin produced in a ring spinning frame is applied as a yarn feeding bobbin, much volume of fly may be generated at the yarn unwinding part A or the tension unit and the like due to contact between the yarns or a contact between the yarn and the component elements of the tension unit. Covers 19 and 20 for covering the place where the fly is generated are arranged at the place.

The cover at each of the above-described positions will be described in detail. In FIGS. 2 to 4 is illustrated a schematic construction of the present invention. That is, a first cover 19 covering the yarn feeding bobbin 4 is composed of a cylindrical cover 21 having a distance S in respect to an outer circumferential surface of the yarn layer 4*a* of the yarn feeding bobbin 4, a tapered cover 22 and a balloon breaker 6 subsequent to the tapered cover 22. The first cover 19 is fixed to the main body of the winding unit with a bracket 23.

It is preferable that a second cover 20 covering the tension part is a cover for use in covering four sides and the top surface of the tension part, the lower surface of the cover is provided with an opening 24, and as described later, the cover 20 is formed with a slit for use in passing yarn when the yarns are to be connected or the cover can be opened or closed. The upper surface 25 is formed with a yarn running slit 26 as shown in FIG. 4. Further, to the upper portion of the rear surface of the cover 20 is connected an opening 29 of the suction pipe 28. The tension unit includes, for example, a main body of the tension device composed of a pair of pan plates 30, 31 and the yarn guides 9 and 10 arranged above and below the tension unit. In a certain case, it does not show any problem to add a precleaning device and a gate tension device and the like.

Therefore, the interior of the second cover 20 is reduced in its pressure under a suction force caused by the suction pipe 28, an air flow flowing from the lower opening 24 of the second cover into the cover 20 is generated, and in turn, within the first cover 19, the air flow 32 generated due to an unwinding of the yarn and the ballooning of the yarn ascends along the inner surface of the cover 21, the air flow exited out of the upper opening 33 may ride on the suction air flow caused by the second cover 20 and flows into the second cover 20. That is, the fly generated due to unwinding of the yarn is moved from the first cover 19 into the second cover 20, sucked into the suction pipe 28 together with the fly generated in the second cover 20 and then discharged out.

The cylindrical body 21 of the first cover 19 may be arranged over a full length of the yarn layer of the bobbin 4 and it may also be applied to at least such a length as covering a chase part (a tapered part 4*b* at the upper part of the yarn layer). Since the chase part 4*b* is varied as the unwinding of the yarn is proceeded, it is also possible to move only the first cover 19 in an elevational direction as the chase part is moved.

Further, the distance S between the inner surface 21*a* of the first cover 19 and the surface of the yarn layer 4*a* is preferably set to an appropriate value. That is, when the distance S is too high, the air flow ascending along the inner surface of the first cover 19 is delayed, resulting in making a tendency that the fly is dropped downwardly. In turn, when the distance S is too short and the air flow is moved fast, therefore a flow rate of air is too high, resulting in that it becomes higher than that of the suction air flow caused by the second cover 20, the air flow directed from a clearance between the first and second covers 19 and 20 outwardly is produced and the fly may be dispersed. Therefore, although the distance S is defined to a desired value in reference to the sucked flow rate of the suction pipe 28, for example, if the flow rate of suction in the suction pipe 28 is 500 l/min, it is appropriate that the distance S is about 10 to 30 mm.

That is, if it is assumed that a flow rate of suction in the suction pipe 28 is defined as Q, and if the distance S is set such that a relation of $Q=a+b$ is established between a flow rate of air flowed into the second cover, that is, a flow amount of air a flowed from the outside in a direction of arrow 34 under the abovedescribed suction force and a flow amount of air b flowed from the upper opening 33 of the first cover 19 in a direction indicated by an arrow 35, a smooth air flow may be generated and the fly may not be scattered out of the cover.

Figure 5:
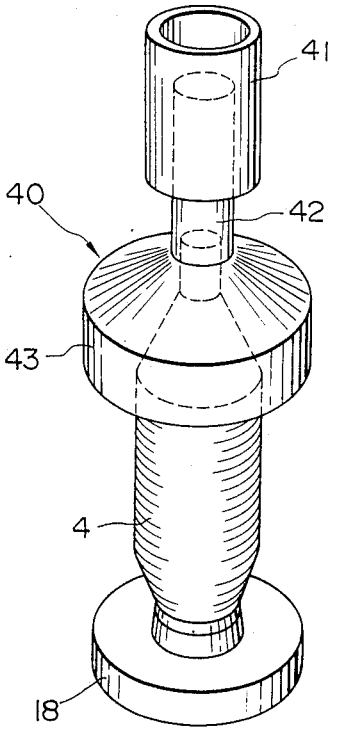
FIG. 5 is a perspective view for showing another preferred embodiment of a first cover.
Figure 6:
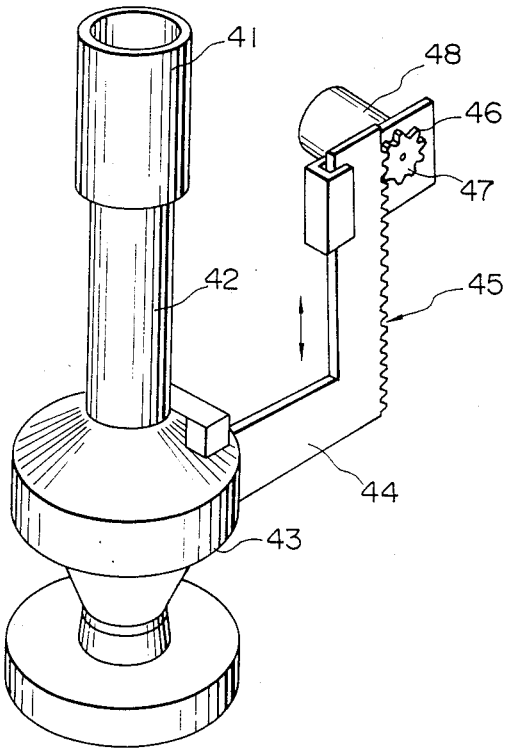
FIG. 6 is a perspective view for showing means for moving the cover.
Figure 7:
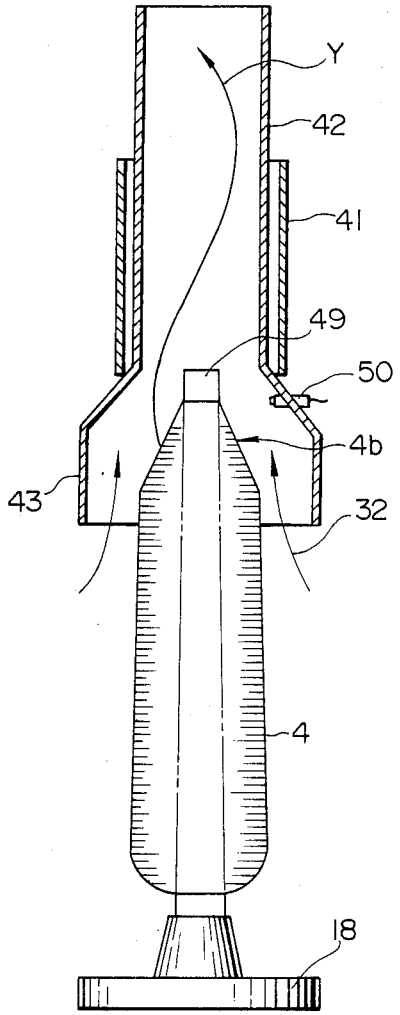
FIG. 7 is a front elevational view in section for showing the cover shown in FIG. 5.
Figure 8:
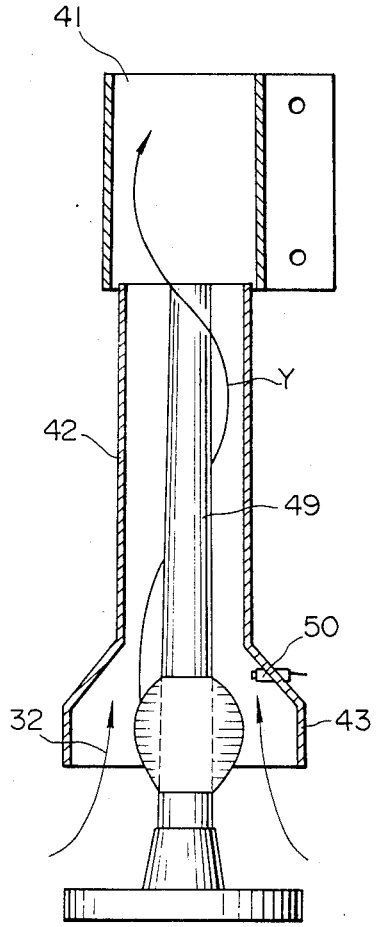
FIG. 8 is a front elevational view in section for showing the cover shown at a position illustrated in FIG. 6.

Referring now to FIGS. 5 to 8, another preferred embodiment of the first cover will be described. This preferred embodiment is a type in which a cover 40 is axially moved along the bobbin 4. That is, since the cover covering the surrounding part of the bobbin becomes an obstacle when the bobbin is to be supplied or discharged, it is necessary to provide a cover escaping mechanism in a practical production machine. In FIGS. 5 and 6, the first cover 40 is made such that a sliding part 42 to be entered into or taken out of the fixed guiding cylinder 41 and a main body 43 of the cover covering the chase part of the bobbin 4 are integrally formed, a bracket 44 is fixed to the main body 43 of the cover, and a rack 45 formed in the bracket 44 is engaged with a pinion 47 supported in the fixed plate 46. The pinion 47 is rotated by driving means such as a stepping motor 48 and the like. Further, within the main body 43 is arranged a sensor 50 for use in sensing an interface point between the yarn layer 4*b* of the bobbin and a take-up tube 49, and the motor is controlled for its driving operation in such a way as it may trace the chase part. That is, as the yarn is unwound and the chase part is moved downwardly, so that the cover 43 covering the chase part is followed. FIG. 7 shows the position of the cover 40 when the bobbin is full of yarn and FIG. 8 shows a position of the cover 40 when the yarn layer is decreased in its volume. As described above, since the fly may be generated from the bobbin at a place where the yarn is removed from the yarn layer, the place is covered by the cover, the fly may not be scattered, the fly is passed through the guiding cylinder 41 from the cover 40, advanced into the above-described second cover and then discharged by the suction pipe. Both the guiding cylinder 41 and the sliding part 42 have a function acting as a balloon breaker.

Further, the rack and pinion mechanism has been shown as a lifting or descending mechanism for the main body 43 of the cover and it is possible to apply other various mechanisms, for example, a hydraulic cylinder and a mechanism of belt and pulley and the like.

Figure 9:
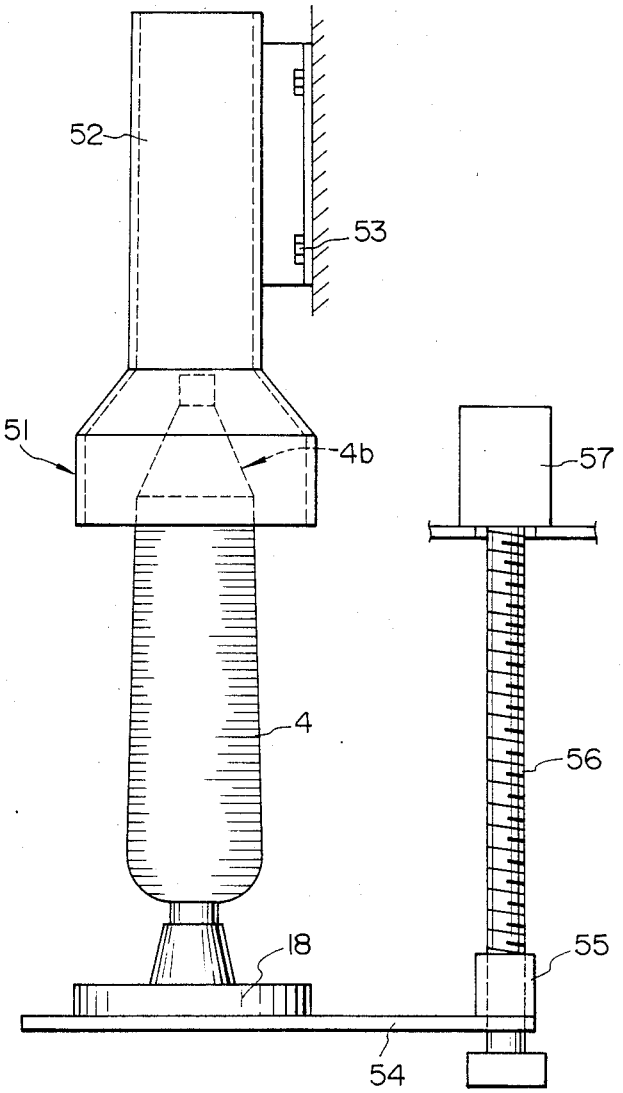
FIG. 9 is a front elevational view for showing a still further preferred embodiment of a first cover.

FIG. 9 illustrates another preferred embodiment of the first cover. That is, in this preferred embodiment, the first cover 51 is fixed and the bobbin 4 is moved as the yarn layer is decreased. The first cover 51 is fixed integrally to the winding unit by fixing means 53 with a balloon breaker 52. A shape of the cover 51 is the same as that of the above-described preferred embodiment and this is a cover for use in covering only the chase part 4*b*. The bobbin 4 is positioned on a mounting block 54 and fixed on it with the tray 18. The mounting block 54 is made such that its part 55 is threadably engaged with a threaded rod 56 and the mounting block 54 can be moved in an elevational direction under a rotation of the threaded rod 56. A reference numeral 57 designates a threaded rod driving motor. In the first cover is arranged the sensor which is similar to that shown in FIG. 7, the sensor is controlled in such a way as it may detect the chase part, drive the motor as the yarn is decreased and the cover 51 may always cover the chase part 4*b*.

Figure 11:
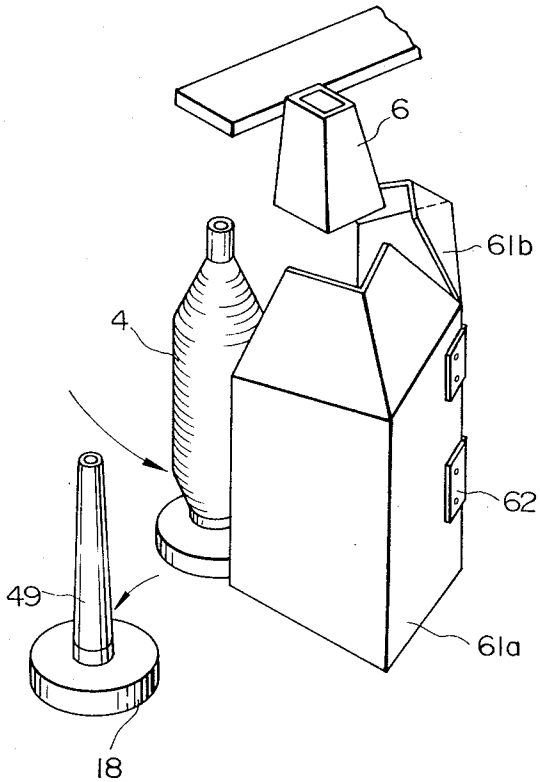
FIG. 11 is a perspective view for showing a condition in which the first cover is opened.
Figure 10:
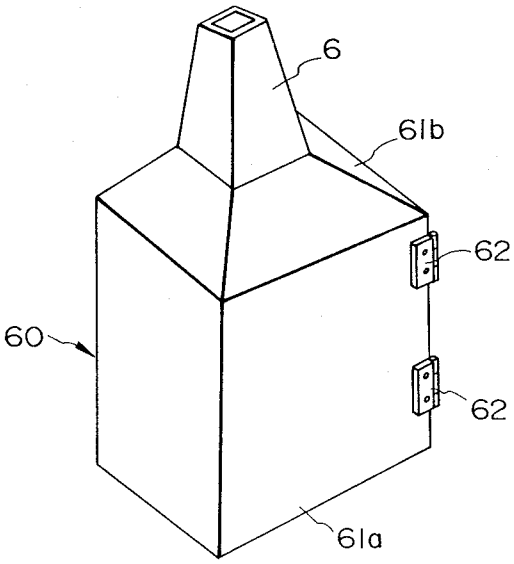
FIG. 10 is a perspective view for showing a still further preferred embodiment of a first cover.

FIGS. 10 and 11 illustrate a still further preferred embodiment of the first cover, this preferred embodiment shows the type in which the first cover may be opened or closed and further the cover 60 covering an entire area of the bobbin. That is, the main bodies 61*a* and 61*b* of the cover are opened or closed by hinges 62 and when the bobbin is to be replaced, the cover at the passage of the bobbin is temporarily opened. The opening and closing of the cover is cooperatively driven by a lever and a rod and the like to a bobbin inserting and discharging mechanism. A reference numeral 6 designates a balloon breaker. A cover 60 shown in the figure indicates a rectangular column and it is also possible that a semicylindrical cover is opened or closed.

Either one of each of the above-described preferred embodiments illustrates the cover in which the bobbin is supplied while being supported on the tray, and therefore, when the bobbin is to be replaced, the air injected from the air injection nozzle mounted below the tray is injected from a clearance in the tray into the take-up tube, the end of the yarn suspended from the upper end into the take-up tube is sucked upwardly, thereby the yarn end is blown out of the upper end opening of the cover upwardly and sucked and held in the waiting relay pipe. Therefore, a cylinder body having its surrounding completely closed may be applied as the first cover. In the case of a winding unit having a magazine, the bobbin is dropped and supplied onto a bobbin supporting peg while the yarn end is sucked at a central hole of the magazine. In such a case the first cover may be formed with a yarn inserting slit or an opening or closing type cover.

A preferred embodiment of a second cover covering the tension unit will be described.

Figure 12:
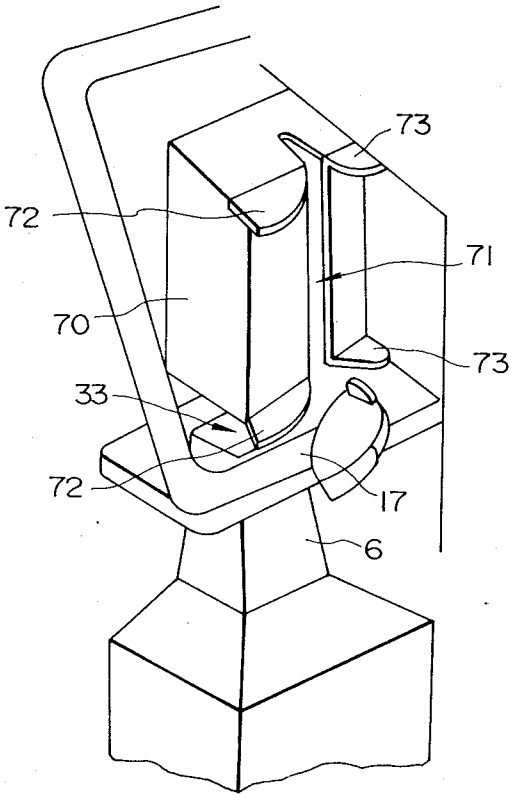
FIG. 12 is a perspective view for showing a preferred embodiment of a second cover.

FIG. 12 illustrates a fixed type of a second cover 70 in which a front surface of the box-like cover 70 is formed with a yarn inserting slit 71 and guide plates 72 and 73 and the like. Therefore, when the yarns are connected to each other, a yarn end at the bobbin is sucked and held by a relay pipe 17 which is rotated or oscillated between the upper opening end 33 of the balloon breaker 6 and the second cover 70, the yarn connected to the bobbin as the relay pipe 17 is returned and rotated is passed through the slit 71 and inserted into the desired position at the tension unit. A structure of the second cover 70 is the same as that shown in FIGS. 3 and 4.

Figure 13:
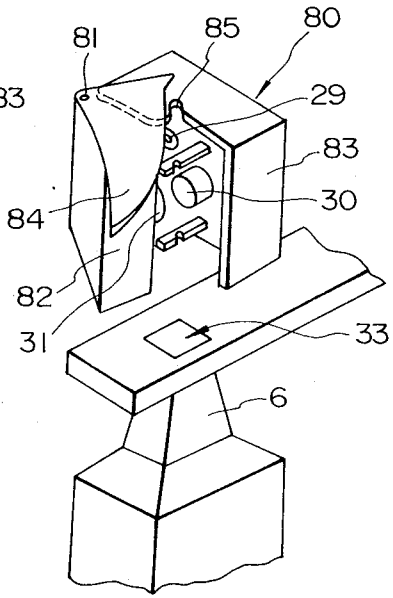
FIG. 13 is a perspective view for showing another preferred embodiment of the second cover.
Figure 14:
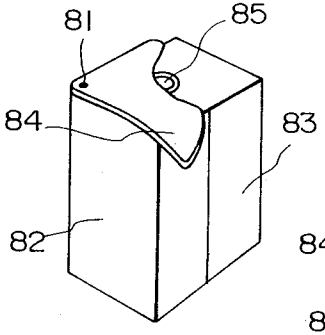
FIG. 14 is a perspective view for showing a condition in which the cover shown in FIG. 13 is closed.

FIGS. 13 and 14 illustrate another preferred embodiment of a second cover, wherein a type of cover to be opened or closed only when the yarns are connected to each other is illustrated. That is, the cover 80 is composed of a movable cover 82 which can be opened or closed around a vertical shaft 81 and a fixed cover 83 fixed to the winding unit, the movable cover 82 is formed with a yarn inserting guide 84, the upper surface of the fixed cover 83 is formed with a yarn guiding groove 85 which is applied during a running of the yarn. When the yarns are connected to each other, the movable cover 82 is opened as shown in FIG. 13 in cooperation with the movement of the movable pan plate 31 of the tension mechanism, a yarn end of the bobbin is inserted into the tension unit and set at a specified position. When the yarn is to be wound, as shown in FIG. 14, the second cover is kept closed to cover the tension unit and the fly is sucked and discharged under the above-described action of the suction pipe 29.

In the above description, it is disclosed that the first cover covering a yarn feeding bobbin and a second cover covering the tension unit are separated, the suction pipe is opened into the second cover and an air flow is generated in the first cover by the balloon of the unwound yarn. A change in design can be made in which the first cover and the second cover are made as a continuous cover or either one of the first cover or second cover is formed with a suction pipe opened thereinto. In this case, although it is necessary to make an arrangement in replacing of bobbin and guiding of the yarn end at the bobbin during the connection of yarns and the like, either one of them is effective for providing a countermeasure against the fly.

Further, in FIG. 3, it is also possible that a pipe for feeding steam is opened into the first cover 19, the atmosphere around the unwound yarn is made to be wet to restrict a generation of fly, to promote a prevention of breakage caused by a twisting unit or to prevent a generation of static electricity in the yarn.

As described above, in the present invention, a cover for covering a winding unit at a place where fly may easily be generated and a suction pipe for sucking and discharging the fly generated in the cover is opened into the cover, thereby much volume of generated fly can be discharged and removed in a quite effective manner and a scatter of fly into the factory can be prevented more effectively than that of the conventional type of cleaning device.

What is claimed is:

1. An apparatus for preventing scatter of fly in a winder having at least one winding unit in which a yarn is unwound from a yarn feeding bobbin and is directed through a tension unit before being taken-up on a take-up package, said apparatus comprising: a first cover member for covering the yarn feeding bobbin unwound at the winding unit; a second cover member for covering the tension unit; and means for directing a fluid flow through the interior of both said first cover member and said second cover member, whereby fly generated within said first cover member and said second cover member are removed via said fluid flow.

2. The apparatus as claimed in claim 1, wherein said first cover member comprises a cover body spaced from the outer circumferential surface of the yarn layer of the yarn feeding bobbin by a predetermined distance, a tapered cover connected to and extending from the end of the cover body nearest the tension unit, and a balloon breaker interposed between the tapered cover and the tension unit.

3. An apparatus for preventing scatter of fly in a winder having at least one winding unit in which a yarn is unwound from a yarn feeding bobbin and is directed through a tension unit before being taken-up on a take-up package, comprisng a first cover member for covering the yarn feeding bobbin unwound at the winding unit and a second cover member for covering the tension unit, wherein said bobbin includes a yarn layer having a tapered part at the upper portion thereof, and wherein said first cover member substantially covers the tapered part at the upper portion of the yarn layer and further comprising means for moving said first cover member in an elevational direction as the tapered part of the yarn layer is moved during the unwinding of the yarn layer.

4. The apparatus as claimed in claim 3, wherein said first cover member comprises a fixed guiding cylinder, a sliding part configured to be introduced into or removed from the fixed guiding cylinder, a main cover body for covering the upper tapered part of the yarn layer formed integrally with the sliding part, means for moving the main cover body along the axis of the bobbin, and a sensor for sensing the interface between the yarn layer of the bobbin and the take-up tube.

5. The apparatus as claimed in claim 4, wherein said means for moving the main cover body comprises a rack secured to the main cover body by a bracket, a pinion which is supported on a fixed plate and is engaged with the rack, and a stepping motor for driving the pinion, said stepping motor being controlled by the sensor.

6. An apparatus for preventing scatter of fly in a winder having at least one winding unit in which a yarn is unwound from a yarn feeding bobbin and is directed through a tension unit before being taken-up on a take-up package, comprising: a first cover member for covering the yarn feeding bobbin unwound at the winding unit and a second cover member for covering the tension unit, wherein said bobbin includes a yarn layer having a tapered part at the upper portion thereof, and wherein said first cover member comprises a fixed cover body substantially covering the tapered part at the upper portion of the yarn layer, further comprising a balloon breaker fixed integrally to the cover body, a sensor disposed within the cover body for detecting the interface between the feeding bobbin and the yarn layer and generating a signal in response thereto, and a mounting block on which the bobbin may be positioned and fixed, said mounting block being threadably engaged with a threaded rod so as to be movable along the axial direction of the bobbin by the rotation of the threaded rod, and rotation means responsive to said signal for rotating said threaded rod.

7. The apparatus as claimed in claim 1, wherein said first cover member substantially covers the entire surface area of the bobbin and further comprising means for temporarily opening said first cover when the bobbin is to be replaced.

8. The apparatus as claimed in claim 1, wherein said second cover member substantially covers the tension unit and is provided with a yarn running slit and wherein said means for directing a fluid flow further comprises a suction pipe provided at an upper portion of the second cover member.

9. The apparatus as claimed in claim 8, wherein said second cover member is formed with a slit at the front face thereof for use in passing a yarn.

10. The apparatus as claimed in claim 1, wherein said second cover member comprises a movable cover which can be opened or closed around a vertical shaft and a fixed cover fixed to the winding unit, said fixed cover being formed with a yarn guiding groove on the upper surface thereof.

11. A device for removing fly generated during the unwiding of yarn from a bobbin by a winding unit having a yarn tension unit comprising:

a first enclosure for substantially enclosing the region of the bobbin from which yarn is unwound;

a second enclosure for substantially enclosing the yarn tension unit, means for directing a fluid flow through the interior of both said first enclosure and said second enclosure;

whereby fly generated within said first enclosure and said second enclosure are removed via said fluid flow.

12. A device as in claim 11 wherein said means for directing a fluid flow comprises a suction pipe in communication with the interior of said second enclosure.

13. A device as in claim 11 further comprising:

a balloon breaker disposed intermediate said first enclosure and said second enclosure.

14. A device as in claim 11 further comprising:

means for producing relative motion between said bobbin and said first enclosure, whereby said first enclosure substantially surrounds the region of the bobin from which yarn is removed through out the unwinding operation.

15. A device as in claim 14 wherein said bobbin includes a take-up tube having a yarn layer wrapped therearound and said means for producing relative motion comprises a sensor for detecting the interface between the take-up tube and the yarn layer and generating a signal in response thereto.

16. A device as in claim 11 further comprising:

moisture means for introducing moisture into the interior of at least one of said enclosures, said moisture inhibiting the scattering of fly in said winding unit.

17. A device as in claim 11 wherein said first enclosure further comprises:

a first enclosure section and a second enclosure section, said first and second sections being mutually displaceable to thereby allow the introduction of a bobbin into the first enclosure.

* * * * *